United States Patent [19]

Tsukamoto

[11] 4,293,103

[45] Oct. 6, 1981

[54] METAL WIRE WINDING APPARATUS

[76] Inventor: Kotaro Tsukamoto, 7-8, Kashima 4-chome, Yodogawa-ku, Osaka City, Osaka Prefecture, Japan

[21] Appl. No.: 104,463

[22] Filed: Dec. 17, 1979

[51] Int. Cl.[3] ..... B21C 47/00; B65H 54/80

[52] U.S. Cl. ..... 242/83

[58] Field of Search ..... 242/82, 83

[56] References Cited

U.S. PATENT DOCUMENTS

| | | | |
|---|---|---|---|
| 2,703,686 | 3/1955 | Bell | 242/82 |
| 2,863,615 | 12/1958 | Kenmore et al. | 242/83 |
| 2,929,577 | 3/1960 | Henning | 242/83 |
| 3,113,745 | 12/1963 | Bittman | 242/83 |
| 3,337,154 | 8/1967 | Smith, Jr. et al. | 242/83 |
| 3,624,877 | 12/1971 | Sanders | 242/82 X |

*Primary Examiner*—Stanley N. Gilreath

*Attorney, Agent, or Firm*—Wenderoth, Lind & Ponack

[57] ABSTRACT

A winding apparatus for metal wire is provided where a carrier table for receiving wound turns of the wire is rotated at a periodically varying speed to change the diameter of the wire turns shed from a winding drum onto the carrier table in such a manner that the shed wire turns may form a well-shaped coil around a carrier guide on the table.

2 Claims, 6 Drawing Figures

METAL WIRE WINDING APPARATUS

BACKGROUND OF THE INVENTION

In a typical prior art wire winding apparatus, the carrier table for receiving the wound wire turns shed from the winding drum is designed to be rotated at the same and synchronized speed with the winding drum causing the wire turns wound around and shed from the winding drum onto the table to have substantially the same diameter. The shed wire turns of substantially the same diameter move successively down along the carrier guide onto the carrier table. With the carrier table being rotated at a constant speed and the shed wire turn having substantially the same diameter, the wire turns tend to fall and accumulate approximately at the same radial position on the carrier table. In other words, they are not uniformly distributed in radial direction on the carrier table. The wire turns thus accumulated from a loose coil having a bed configuration similar to an obliquely cut segment of a cylindrical body.

In order to avoid the above problem, it has been proposed to employ a planetary carrier table which revolves about a fixed center while rotating about its own axis. As the carrier table undergoes the planetary motion, the wire turns are peritrocoidly taken up by the carrier with the center of the successive turns moving around the revolving axis. However, in order to have such planetary carrier table, a special driving mechanism is needed which adds the installation cost and occupies a large space.

SUMMARY OF THE INVENTION

It is a first object of the invention to provide a metal wire winding apparatus which is free of the drawbacks of the conventional apparatus and capable of forming a well-shaped coil of wire.

It is a second object of the invention to provide a metal wire winding apparatus where the rotational speed of the carrier table is periodically increased and decreased in order to periodically vary the diameter of wound wire turns such that the wire turns are uniformly distributed radially on the table into forming a tightly packed and well-shaped coil of the wire.

It is a third object of the invention to provide a metal wire winding apparatus which is capable of forming a coil of any desired inner and outer diameters by suitably selecting the maximum and minimum rotational speed of the carrier table.

Generally speaking, as turns of the metal wire would around the winding drum move off the drum onto the carrier table under their own weight, they tend to radially expand beyond the outer diameter of the winding drum because the metal wire has its own resiliency. While on the other hand, if the carrier table is rotated at the same speed as the winding drum, forces are applied to the wire turns which cause them to radially shrink to a smaller diameter, and the higher the rotational speed of the table the greater such forces. We assumed that the diameter of the wire turns might be changed between their diameter as they are formed around the drum and their diameter as they fall on the carrier table by suitably changing the rotational speed of the carrier table, thereby providing coils of the wire turns with any desired inner diameter. After carrying out various experiment, we have found that the maximum rotational speed of the carrier table determines the inner diameter of the wire coil to be formed, while the minimum rotational speed of the carrier table the outer diameter of the formed coil. We have also found that if the rotational speed of the carrier table is suitably varied, then the wire turns shed from the drum fall at slightly different radial positions on the table resulting in a uniform distribution of the wire turns in radial direction on the table.

BRIEF DESCRIPTION OF THE DRAWINGS

The present invention is made on the above mentioned discovery and the manner in which the foregoing and other objects of this invention will be apparent from the following description taken in connection with the accompanying drawings, in which.

DESCRIPTION OF THE PREFERRED EMBODIMENT

Figure 1:
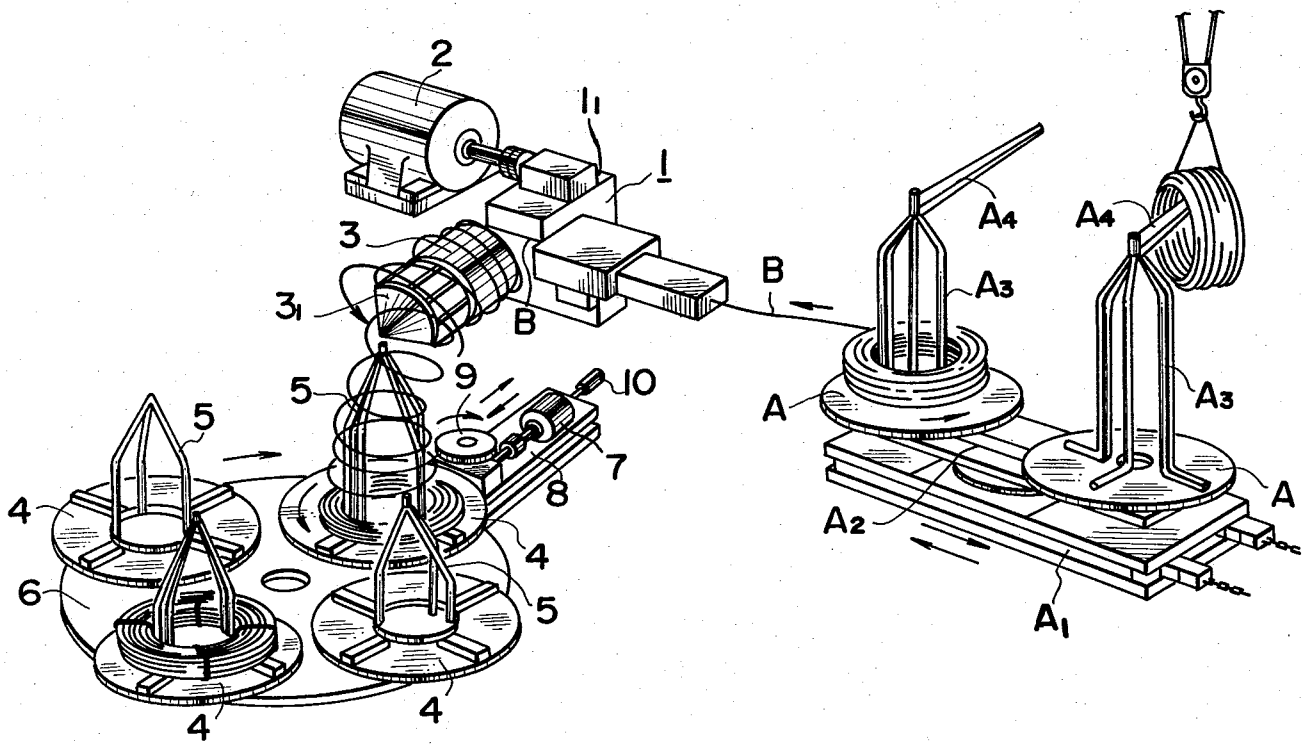
FIG. 1 is a perspective view of a metal wire winding apparatus embodying the invention.
Figure 2:
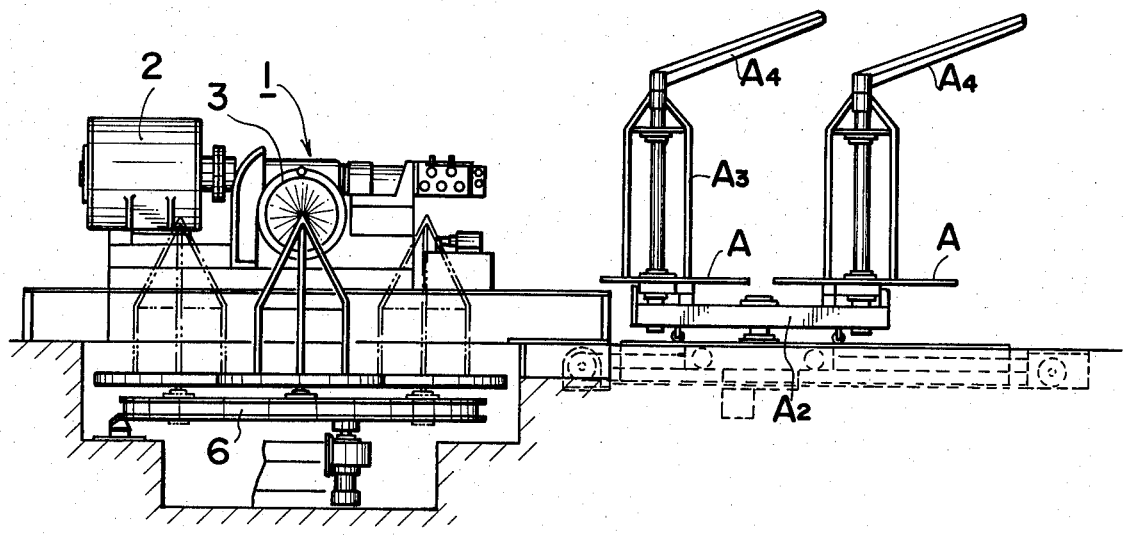
FIG. 2 is a front view of the apparatus.
Figure 3:
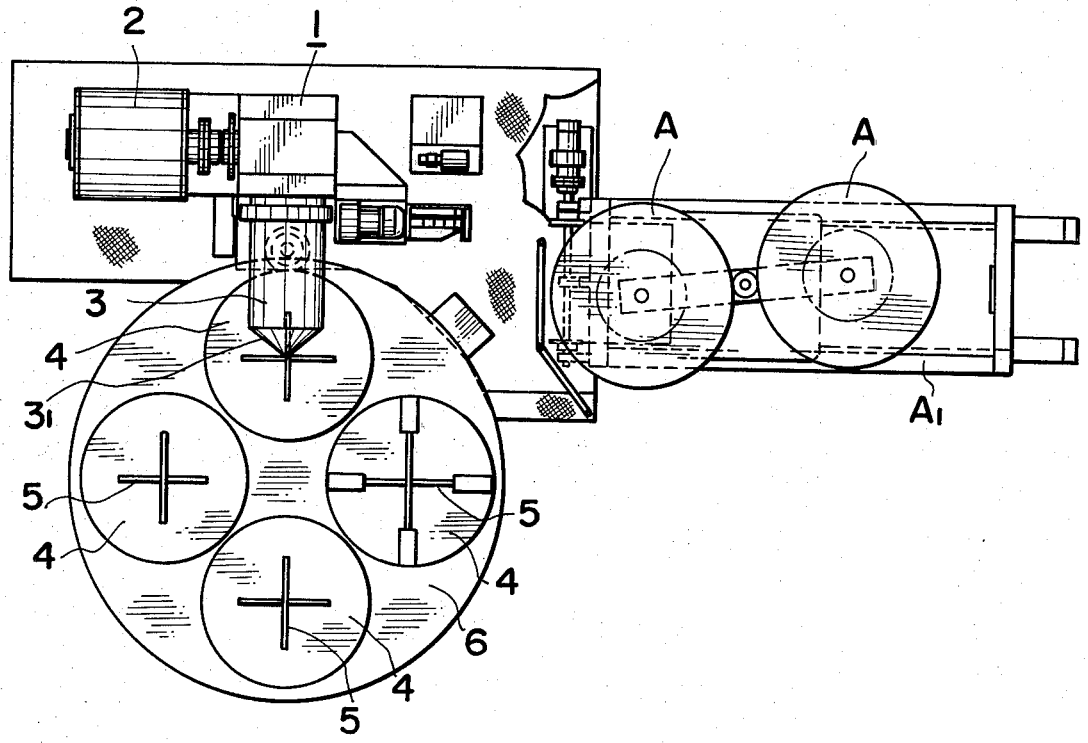
FIG. 3 is a plan view of the apparatus.
Figure 4:
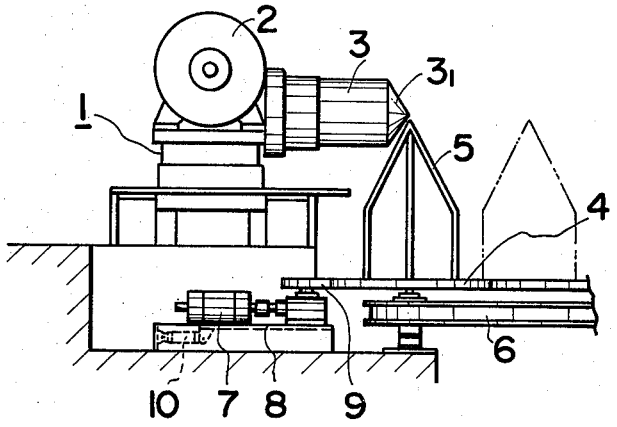
FIG. 4 is a side view of the apparatus.
Figure 5:
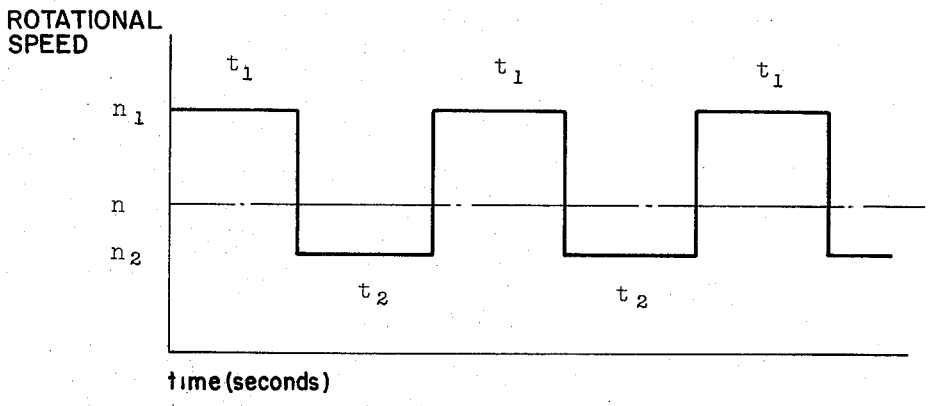
FIG. 5 is a graphical illustration showing relationship between the rotational frequency of the carrier table in the apparatus and time.
Figure 6:
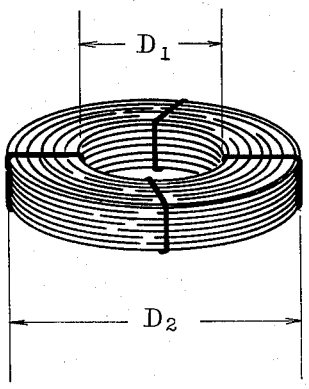
FIG. 6 is a perspective view of a coil formed by the apparatus of the invention.

Referring now to the attached drawings, there is provided according to the invention a wire drawing apparatus 1 for drawing metal wire B from a supply stand A to a wire of a predetermined contact diameter. The wire drawing apparatus 1 is adapted to be driven by an electric motor 2 through a suitable speed reduction means. Mounted horizontally on the base $\mathbf{1}_1$, of the drawing apparatus 1 is a winding drum 3 which is also driven by the motor 2 through a suitable speed reduction means for winding the wire B drawn out of the apparatus and shedding turns of the drawn out wire along a conically shaped cap member $\mathbf{3}_1$. The turns of the wire moving downward along the conical cap member are received on carrier tables 4. Each of the carrier tables 4 has mounted thereon a carrier guide 5 around which the wire turns are placed to form a coil of the wire. A plurality of similar carrier tables 4 having carrier guides 5 of one size or different sizes are provided on a large turntable 6 so the the wire winding operation would not have to be interrupted for the bundling of a coil formed on one carrier table. When coils of a different diameter are to be formed, carrier tables with carrier guides of a desired size are selected and mounted on the turntable 6. A D.C. electric motor 7 is mounted on a slide base 8 for driving a friction roller 9 which is adapted to be brought into contact with the periphery of the carrier table 4 for rotatably driving the same. The slide base 8 is moved longitudinally back and forth by a pneumatic cylinder 10. When the turntable 6 is to be rotated for placing a new carrier table in position for receiving wire turns, the slide base 8 is retracted away from the turntable to allow the same freely.

For efficient operation, a pair of supply stands A are rotatably mounted at the opposite ends of a plate $A_2$ which is supported for horizontal rotation on a carrier block $A_1$. An inclined guide bar $A_4$ is attached at the top of a guide member $A_3$ of each supply stand A by which a supply wire in the form of a coil carrier by a crane is directed towards the guide member for smooth shedding of the supply coil of wire therealong.

Now, concerning the maximum and minimum rotating speeds of the carrier table 4 and the time when the rotating speed of the carrier table is switched over from the one to the other, with the rotational speed of the winding drum 3 being constant, the rotation of the carrier table must be controlled in such a manner that the average rotational speed of the carrier table may be the same as the constant rotational speed of the winding drum. Otherwise, undesired results such as dropping of and slacking in the wire could occur before each complete turn of the wire is formed around the carrier guide.

Accordingly, the following relationship must be substantially satisfied during operation of the system.

$$n(t_1+t_2)=n_1t_1+n_2t_2$$

where n: the rotational frequency of the winding drum 3.

$n_1$: the maximum rotational frequency of the carrier table 4 corresponding to the inner diameter of the formed coil $n_2$: the minimum rotational frequency of the carrier table 4 corresponding to the outer diameter of the formed coil $t_1$: the time during which the carrier table exhibits the maximum rotational frequency $t_2$: the time during which the carrier table exhibits the minimum rotational frequency.

That is to say, when it is desired to wind a coil having an inner diameter $D_1$ and an outer diameter $D_2$, then by using a table wherein the relationships between the diameters of coil turns and the rotational frequencies of the carrier table have been previously plotted, the maximum rotational frequency $n_1$ for the particular inner diameter $D_1$ and the minimum rotational frequency $n_2$ for the particular outer diameter $D_2$ are determined. The control voltage of the D.C. motor 7 is set by a speed selector (not shown) at values for providing the rotational frequencies $n_1$ and $n_2$. On the other hand, the time $t_1$ during which the maximum voltage is applied is determined such that all of the wire turns previously wound around the drum 3 would not be shed out. When the time $t_1$ is decided, the time $t_2$ during which the minimum voltage is applied is also automatically determined. $t_1$ and $t_2$ are set by a timer (not shown) as the switch-over time.

Here, n, $n_1$, and $n_2$ are presented in rotations per second, while $t_1$ and $t_2$ are presented in seconds.

The operation are advantages of the illustrated wire winding apparatus embodying the invention is now explained.

Turntable 6 is rotated until the carrier table 4 with the carrier guide 5 having a size corresponding to the inner diameter of the coil to be formed is brought to the position for receiving the wound wire turns. As the desired carrier table is positioned in place, the pneumatic cylinder 10 is actuated to advance the slide block 8 for moving the friction roller 9 into frictional engagement with the outer periphery of the carrier table 4. A power switch on the control panel is closed to energize the motors 2 and 7. Upon energization of the motor 2, the metal wire B is drawn from the supply coil on the supply stand A through the wire drawing machine 1 to be formed into a continuous wire of the desired diameter. The drawn out wire B from the machine is wound around the winding drum 3. As several turns of the wire are formed around the winding drum 3, they fall under their own weight onto the carrier table 4 disposed directly below the drum. With the carrier table being rotated at varying speeds by the motor maintaining the previously set rotational frequency to time relationship, wire turns shed onto the carrier table while the latter is rotated at the rotational frequency of $n_1$ are wound up by the carrier guide 5 with their diameter being at $D_1$, and wire turns shed onto the carrier table while the latter is rotated at the rotational frequency of $n_2$ are wound up by the carrier guide 5 with their diameter being at $D_2$. That is, the wire turns having the diameter $D_1$ are wound in a number of $n_1/t_1$ and the wire turns having the diameter of $D_2$ are taken up in a number of $n_2/t_2$. Tension on the wire turns as they are being shed onto the carrier table changes each time when the rotational speed of the table varies. As a result, the wound wire turns fall at such different positions around the carrier guide and on the carrier table that the succeeding wire turns are radially displaced from the preceeding wire turns on the table. The taken up wire turns are thus uniformely distributed in both radial and vertical directions on the carrier table without causing wire turns to be stacked or accumulated in substantially different heights at different radial positions on the table, and a tight and well-shaped cylindrical coil of wire is formed.

As described in detail herein above, according to the metal wire winding apparatus of the invention, the carrier table for receiving the turns of the metal wire formed around the winding drum is designed to be rotated at a periodically increasing and decreasing speed in order to vary the diameter of the wire turns taken up by the carrier guide such that the wire turns are are uniformly distributed in radial direction into forming a tightly packed and well-shaped coil. According to the invention, the necessity for a huge installation as in the prior art where wire turns are taken up peritrocoidly by the planetary rotation of the carrier tables is eliminated. The apparatus of the invention can be electrically controlled, has a simple and trouble free construction and is capable of a smooth winding operation. Moreover, the apparatus is capable of producing coils of substantially any desired inner and outer diameters by suitably selecting the maximum and minimum rotational frequencies of the carrier table. It is, therefore, possible for the present apparatus to provide any coils demanded by users.

What is claimed is:

1. A winding apparatus for metal wire comprising:

a winding drum horizontally disposed on a base for winding turns of wire therearound;

at least one carrier table disposed below said winding drum;

a carrier guide mounted on said at least one carrier table for guiding said wire turns from said winding drum therealong onto said table, thereby forming a coil of said turns of wire on said table;

a motor means mechanically connected to said winding drum for rotating said winding drum at a fixed rotational speed;

an additional motor means mechanically connected to said at least one carrier table for rotating said table independently of said winding drum;

wherein said rotational speed of said at least one carrier table is periodically varied in a step wise fashion in accordance with the following equation:

$$n(t_1+t_2)=n_1t_1+n_2t_2$$

where $n$ = the rotational speed of said winding drum;

$n_1$ = the maximum rotational speed of said at least one carrier table;

$n_2$ = the minimum rotational speed of said carrier table;

$t_1$ = the time during which said at least one carrier table rotates at the maximum rotational speed;

$t_2$ = the time during which said at least one carrier table rotates at the minimum rotational speed.

2. An apparatus as claimed in claim 1, wherein said additional motor means is mechanically connected to said at least one carrier table by a friction roller drive adapted to be brought into frictional engagement with the outer periphery of said at least one carrier table.

* * * * *